US008001980B2

(12) United States Patent
Lhoyer et al.

(10) Patent No.: US 8,001,980 B2
(45) Date of Patent: Aug. 23, 2011

(54) MULTI-HELICOIDAL APPLICATOR BRUSH

(75) Inventors: Patrick Lhoyer, Mouy (FR); Ed Crutchley, Kent (GB)

(73) Assignee: Alcan Packaging Beauty Services (FR)

( * ) Notice: Subject to any disclaimer, the term of this patent is extended or adjusted under 35 U.S.C. 154(b) by 421 days.

(21) Appl. No.: 11/567,072

(22) Filed: Dec. 5, 2006

(65) Prior Publication Data

US 2007/0157945 A1 Jul. 12, 2007

Related U.S. Application Data

(60) Provisional application No. 60/826,871, filed on Sep. 25, 2006.

(30) Foreign Application Priority Data

Jan. 11, 2006 (FR) ..... 06 00229

(51) Int. Cl.
*A45D 40/26* (2006.01)
*A46B 3/18* (2006.01)

(52) U.S. Cl. ..... 132/218; 15/206

(58) Field of Classification Search ..... 132/218, 132/313, 317, 318, 320; 15/206; 401/129
See application file for complete search history.

(56) References Cited

U.S. PATENT DOCUMENTS

| | | | | |
|---|---|---|---|---|
| 1,620,008 | A * | 3/1927 | Curtis | 15/206 |
| 5,161,554 | A * | 11/1992 | Fitjer | 132/218 |
| 5,638,568 | A * | 6/1997 | Dumler et al. | 15/167.1 |
| 6,280,113 | B1 | 8/2001 | Gueret | |
| 2003/0084913 | A1 * | 5/2003 | Gueret | 132/218 |
| 2005/0150510 | A1 * | 7/2005 | Chant | 132/218 |

FOREIGN PATENT DOCUMENTS

| | | |
|---|---|---|
| DE | 90 18 028 U1 | 11/1992 |
| FR | 2505633 | 5/1981 |
| FR | 2605505 | 4/1988 |
| FR | 2607372 | 6/1988 |
| FR | 2607373 | 6/1988 |
| FR | 2627068 | 8/1989 |
| FR | 2627363 | 8/1989 |
| FR | 2637471 | 4/1990 |
| FR | 2637472 | 4/1990 |
| FR | 26501162 | 2/1991 |
| FR | 2663826 | 1/1992 |
| FR | 2668905 | 5/1992 |
| FR | 2675355 | 10/1992 |
| FR | 2685859 | 7/1993 |
| FR | 2690318 | 10/1993 |
| FR | 2701198 | 8/1994 |
| FR | 2706749 | 12/1994 |
| FR | 2715038 | 7/1995 |
| FR | 2745481 | 9/1997 |
| FR | 2748913 | 11/1997 |
| FR | 2749489 | 12/1997 |

(Continued)

*Primary Examiner* — Rachel R Steitz
(74) *Attorney, Agent, or Firm* — Banner & Witcoff, Ltd.

(57) ABSTRACT

An applicator brush includes a stem, and a plurality of bristles supported by the stem. The stem extends from an end of a rod and includes a first branch and a second branch twisted together, each branch having a non-circular cross-section The bristles are positioned between the twisted first and second branches. In some embodiments, each branch includes a plurality of strands pre-twisted together to create the non-circular cross-section of each branch, forming a multi-helicoidal stem.

23 Claims, 16 Drawing Sheets

FOREIGN PATENT DOCUMENTS

| | | |
|---|---|---|
| FR | 2749490 | 12/1997 |
| FR | 2753614 | 3/1998 |
| FR | 2755693 | 5/1998 |
| FR | 27774269 | 8/1999 |
| FR | 2796531 | 1/2001 |
| FR | 2796532 | 1/2001 |
| FR | 2800586 | 5/2001 |

* cited by examiner

MULTI-HELICOIDAL APPLICATOR BRUSH

CROSS-REFERENCE TO RELATED APPLICATIONS

The present application claims priority to and the benefit of U.S. Provisional Application No. 60/826,871, filed on Sep. 26, 2006, and French Patent Application No. 0600229, filed on Jan. 11, 2005, which applications are incorporated herein by reference and made a part hereof.

TECHNICAL FIELD

This disclosure relates to an applicator brush, including, but not limited to, applicator brushes for mascara or other cosmetics.

BACKGROUND OF THE INVENTION

Applicator brushes are frequently used for various purposes, including application of cosmetic products, such as mascara. These applicators are designed to cooperate with a container or other receptacle forming a reservoir for mascara and typically include a cap designed to close off the receptacle and act as a means of gripping the applicator, an axial rod, and a brush portion. The rod is fixed to the cap at one end and to the brush at the other end. The brush portion includes a metallic twisted wire fixing a plurality of bristles to the brush. Many types of such applicator brushes are known in the art, such as those described in French patents FR 2 505 633, FR 2 605 505, FR 2 607 372, FR 2 607 373, FR 2 627 068, FR 2 627 363, FR 2 637 471, FR 2 637 472, FR 2 650 162, FR 2 663 826, FR 2 668 905, FR 2 675 355, FR 2 685 859, FR 2 690 318, FR 2 701 198, FR 2 706 749, FR 2 715 038, FR 2 745 481, FR 2 748 913, FR 2 749 489, FR 2 749 490, FR 2 753 614, FR 2 755 693, FR 2 774 269, FR 2 796 531, FR 2 796 532, and FR 2 800 586, as well as those described in U.S. Pat. Nos. 4,733,425, 4,861,179, 5,357,987, 5,595,198, 6,241,411, 6,427,700. These existing applicator brushes, such as the prior art brush 30 made from a single metallic twisted wire shown in FIG. 23, suffer from certain disadvantages and drawbacks, including having bristle configurations and dispersions that are less than desirable.

The present invention is provided to solve the problems discussed above and other problems, and to provide advantages and aspects not provided by prior applicator brushes of this type. A full discussion of the features and advantages of the present invention is deferred to the following detailed description, which proceeds with reference to the accompanying drawings.

SUMMARY OF THE INVENTION

The present disclosure provides an applicator brush including a stem, and a plurality of bristles supported by the stem. The stem extends from an end of a rod and includes a first branch and a second branch twisted together, each branch having a non-circular cross-section. The bristles are positioned between the twisted first and second branches.

According to one aspect, each branch of the brush includes a plurality of strands pre-twisted together to create the non-circular cross-section of each branch. Thus, the stem is multi-helicoidal. While in one embodiment, each branch comprises a number of strands in the range of from two to four, in other embodiments, any number of strands could be used, depending on the strand diameter. In other embodiments, the strands can be twisted in a clockwise, counterclockwise, or braided manner.

According to another aspect, the strands are metallic wires.

According to another aspect, the strands are non-metallic fibers, such as, for example, natural fibers.

According to another aspect, the branches are continuous with each other and are formed by folding the stem at an angle of approximately 180 degrees to form a pin having the first and second branches.

The present disclosure also provides a cosmetic applicator brush assembly that includes a container adapted to contain a cosmetic substance and a brush as described above. The container has an end opening, and the handle portion is attachable to the container to cover the end opening, and the stem and bristles are positioned within the container when the handle portion is attached to the container to cover the end opening.

According to one aspect, the container and the handle portion have complementary interlocking structures to attach the handle portion to the container.

The present disclosure also provides a method for manufacturing a cosmetic applicator brush as described above. A plurality of strands are provided, and the plurality of strands are pre-twisted together to form a stem. The stem is folded at an angle of approximately 180 degrees at a fold point to create a pin having a first branch and a second branch. A plurality of bristles are positioned between the first branch and the second branch. Then, the first branch and the second branch are twisted together to secure the bristles between the first and second branches. Typically, to complete the brush, an end of the stem is inserted into a handle portion adapted to be held by a user, however such a handle portion is optional for certain embodiments.

According to one aspect, the bristles are positioned between the first branch and the second branch in parallel relation to each other and in non-perpendicular angled relation to the first branch and the second branch.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
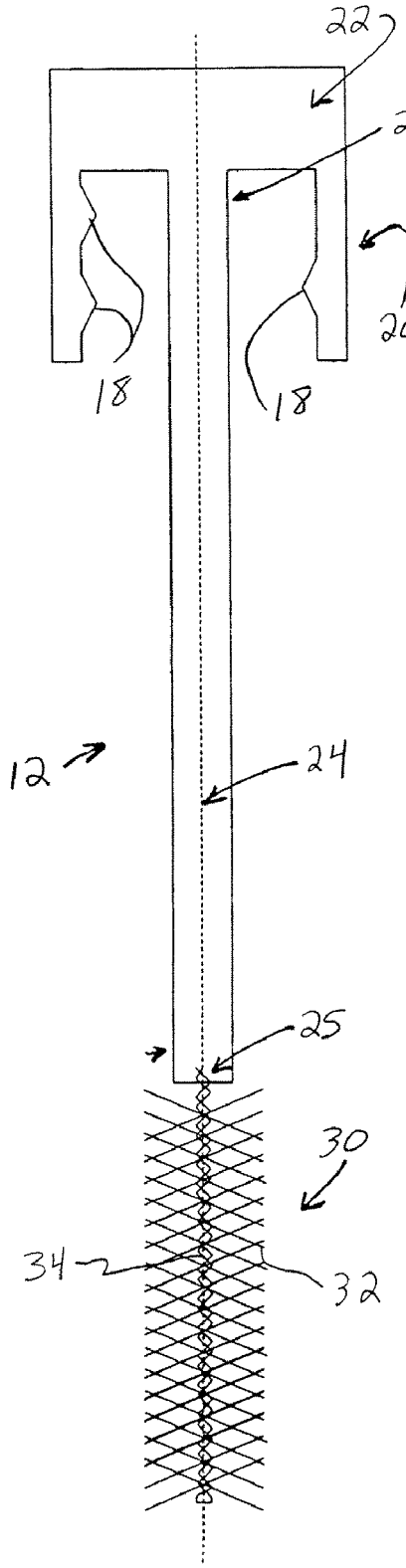
FIG. 1 is a cross-sectional view of one embodiment of an applicator brush.

While the disclosed applicator brush is susceptible of embodiments in many different forms, there are shown in the drawings and will herein be described in detail certain embodiments, with the understanding that the present disclosure is to be considered as an exemplification of the principles of the invention and is not intended to limit the broad aspect of the invention to the embodiments illustrated.

Figure 2:
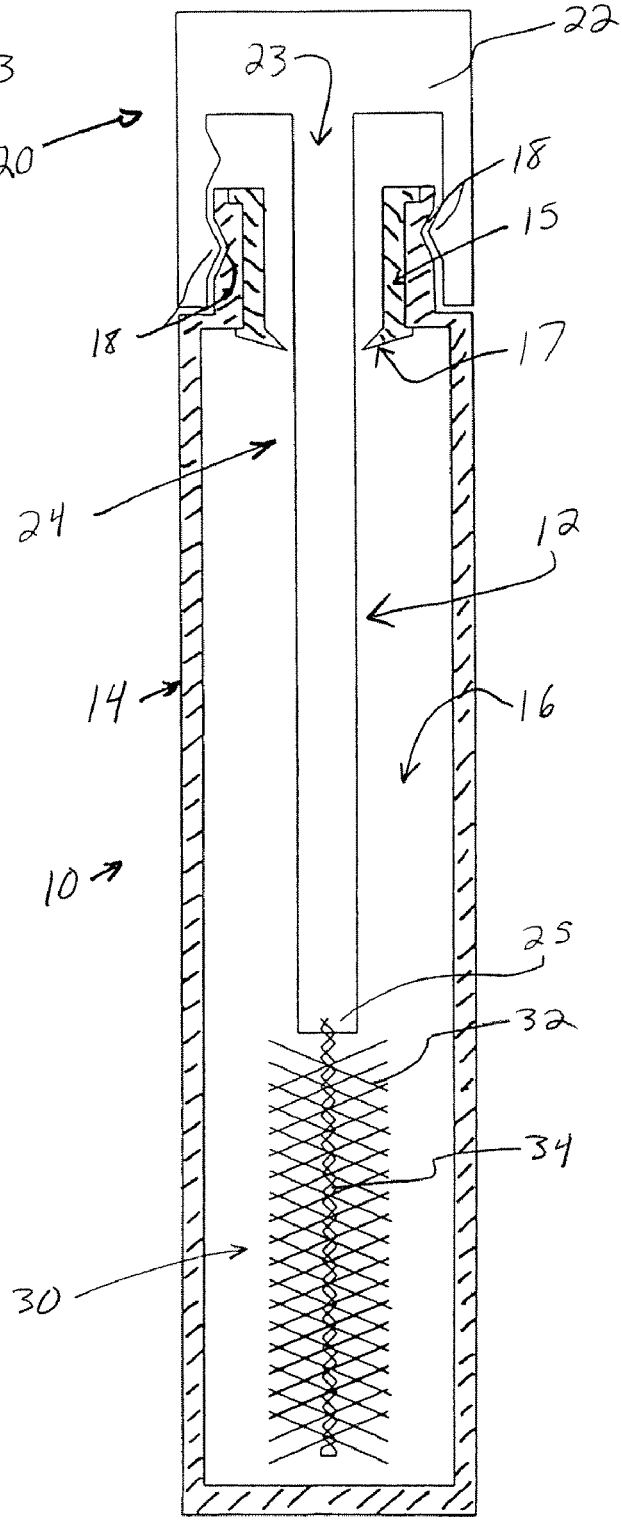
FIG. 2 is a cross-sectional view of one embodiment of an applicator brush assembly incorporating the applicator brush of FIG. 1.

Referring to FIGS. 1 and 2, an applicator brush assembly 10 is shown, including an applicator brush 12 and a container or receptacle 14. The container 14 is generally known in the art, and has an open end 15 and an interior cavity 16 adapted to contain a substance, such as a cosmetic, as well as a collared or narrowed portion 17 for wiping excess substance from the brush 12. The applicator brush 12 includes a handle portion 20 connected to a brush portion 30 having a plurality of bristles 32 supported by a stem 34. The handle portion 20 is adapted to be held by a user, and has a cap portion 22 and a rod 24 extending from the cap portion 22. The rod 24 is attached to the cap portion 22 at one end 23 and to the stem 34 at the other end 25. The stem 34 of the brush portion 30 extends from the end 25 of the rod 24. The cap portion 22 is adapted to be attached to the container 14 to close the open end 15 of the container 14, as shown in FIG. 2. In one embodiment, the container 14 and the handle portion 20 have complementary interlocking structures 18, such as threaded portions, to attach the handle portion 20 to the container 14. The stem 34 and bristles 32 are positioned within the container 14 when the handle portion 20 is attached to the container 14 to cover the end opening 15.

Figure 3:
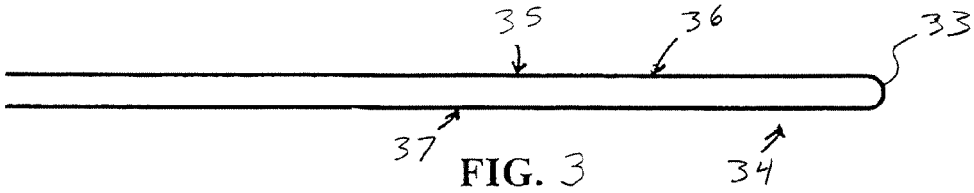
FIG. 3 is a plan view of one embodiment of a stem bent into the form of a pin for use with an applicator brush assembly.
Figure 4:
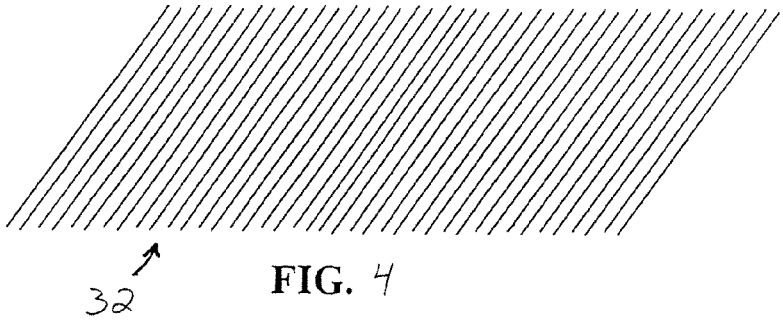
FIG. 4 is a plan view of one embodiment of a plurality of bristles for use with an applicator brush assembly.
Figure 5:
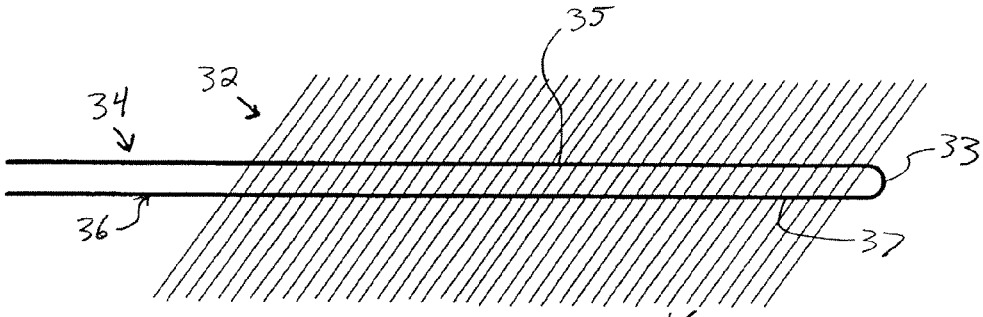
FIG. 5 is a plan view of the bristles of FIG. 4 positioned between two branches of the stem of FIG. 3.
Figure 6:
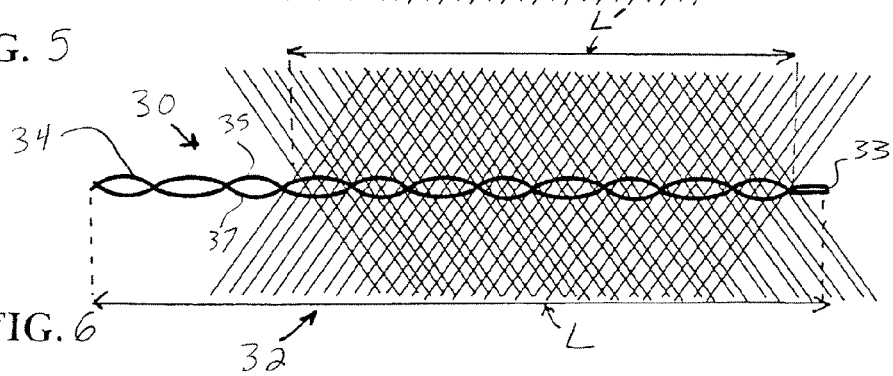
FIG. 6 is a plan view of the stem and bristles of FIG. 5 with the branches of the stem twisted with each other.

FIGS. 3-6 illustrate one general configuration of the brush portion 30. FIG. 3 illustrates the stem 34 before assembly is complete. The stem 34 shown in FIGS. 3 and 5-6 is bent or folded at an angle of approximately 180 degrees at or around a center point 33 of the stem 34 to create a pin 36 having a first branch 35 and a second branch 37 joined together at the folding point 33. Thus, in the embodiment shown, the first branch 35 and the second branch 37 are continuous with each other. In other embodiments, the branches 35,37 may be two separate pieces and may not form the pin 36 shape, or the stem 34 may contain more than two branches 35,37. As shown and described herein, each branch 35,37 advantageously has a non-circular cross-section.

FIG. 4 shows a plurality of bristles 32 arranged in parallel relation to each other. The structure and manufacture of the bristles 32 are generally known in the art, and any of the variety of bristles 32 known in the art may be used with the brush 12, including hollow fiber bristles 32. In assembling the brush portion 30, the bristles 32 are laid across the pin 36 between the branches 35,37 as shown in FIG. 5, and the first and second branches 35,37 of the pin 36 are then twisted together about an axis to create the brush portion 30, having the stem 34 with a plurality of bristles 32 projecting therefrom. As shown in FIG. 6, as the branches 35,37 are twisted, the bristles 32 are trapped and positioned between the branches 35,37, thus supporting the bristles 32 such that the bristles 32 extend from the stem 34 in many directions.

More specifically, in one embodiment, the brush portion 30 includes a twisted stem 34 with a number of turns of two helical branches 35,37 with axial length (L) fixing a plurality of radial bristles 32, as shown in FIG. 6. In this embodiment, the number of turns can vary from 8 to 24 for a typical 26-27 mm long brush portion 30. Generally, the number of turns is higher for a longer brush portion 30. The twisted stem 34 typically has an axial direction, and the plurality of radial bristles 32 form helical bundles of bristles 32 oriented along a so-called radial direction over an axial length (L'), which is less than axial length (L) and varies in the range of from 6 mm to 40 mm, with a number of bristles 32 per turn varying in the range of from 4 to 100. The plurality of radial bristles 32 are fixed to the twisted stem 34 by radial compression applied on the bristles 32 between the central parts facing the two helical branches 35,37 of the twisted stem 34 that form a contact area between them.

Figure 7:
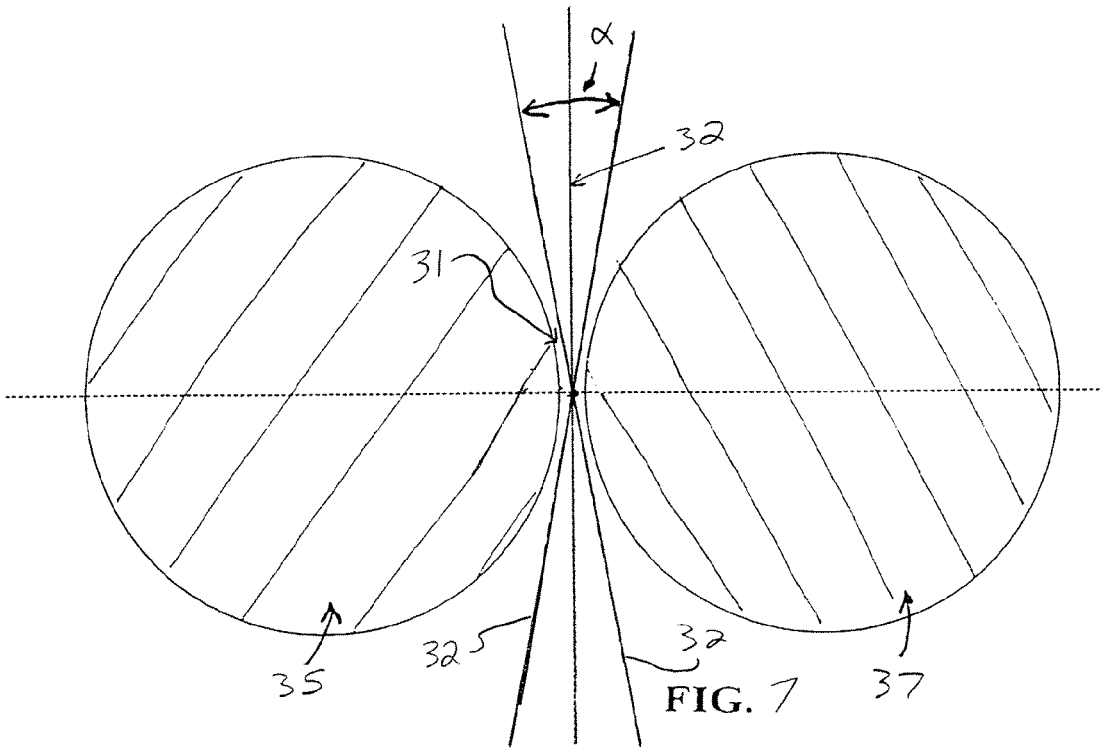
FIG. 7 is a cross-sectional view of a twisted stem of a prior art applicator brush.

Generally, the stem 34 has a means of deviating the plurality of radial bristles 32 from the radial direction, such that the bristles 32 have a larger spread angle $\alpha$, as well as means for controlling or adjusting the deviation of the bristles 32 to create differing arrangements of bristles 32 in the applicator brush 12. The measurement of the spread angle $\alpha$ of a bundle 31 of bristles 32 is illustrated in FIG. 7 with respect to a standard stem 34 consisting of two circular wires 35,37. One or both of these functions can be accomplished by using branches 35,37 of non-circular cross-section in creating the stem 34. In addition, using branches 35,37 of non-circular cross-section accomplishes the function of forming a non-uniform means of distributing the density of the bristles 32. In some embodiments, the non-uniform distribution will be periodic, thus forming helical bundles of bristles 32, each with a variable, periodic bristle density. This non-uniform distribution of bristles 32 allows for a great variety of patterns, densities, and spreads of the bristles to be formed by varying different parameters of the brush 12, as described below.

Figure 8:
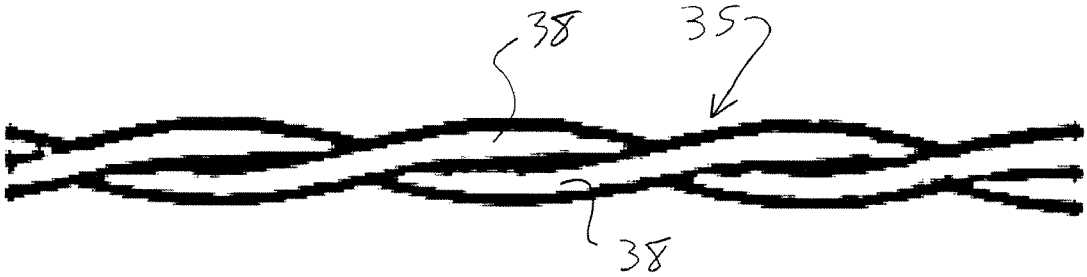
FIG. 8 is a plan view of one embodiment of a branch of a stem for use with an applicator brush assembly, having two pre-twisted strands.
Figure 9:
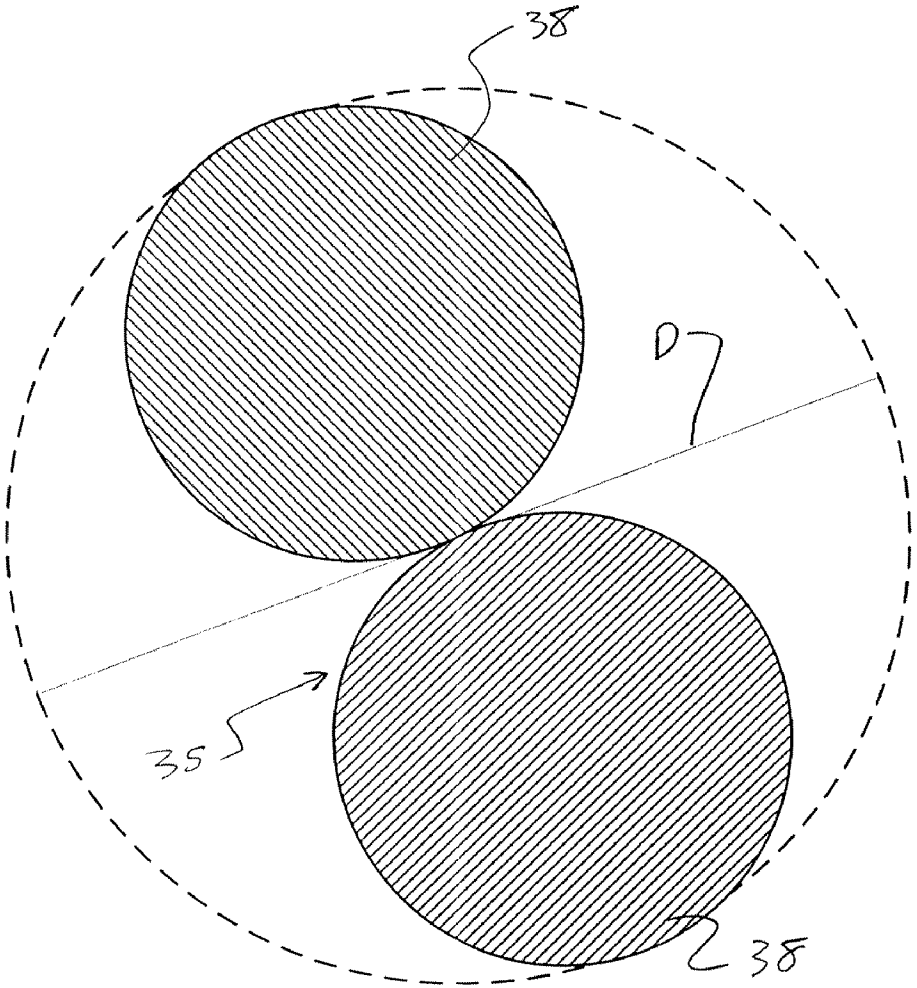
FIG. 9 is a cross-sectional view of the branch of FIG. 8, with broken lines illustrating the periphery of a branch of circular cross-section having the same maximum diameter.
Figure 10:
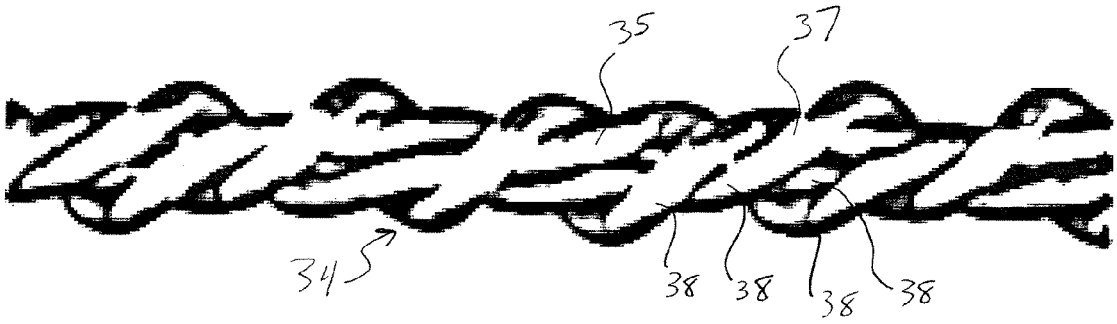
FIG. 10 is a plan view of one embodiment of a stem for use with an applicator brush made by twisting two branches as shown in FIG. 8.
Figure 11:
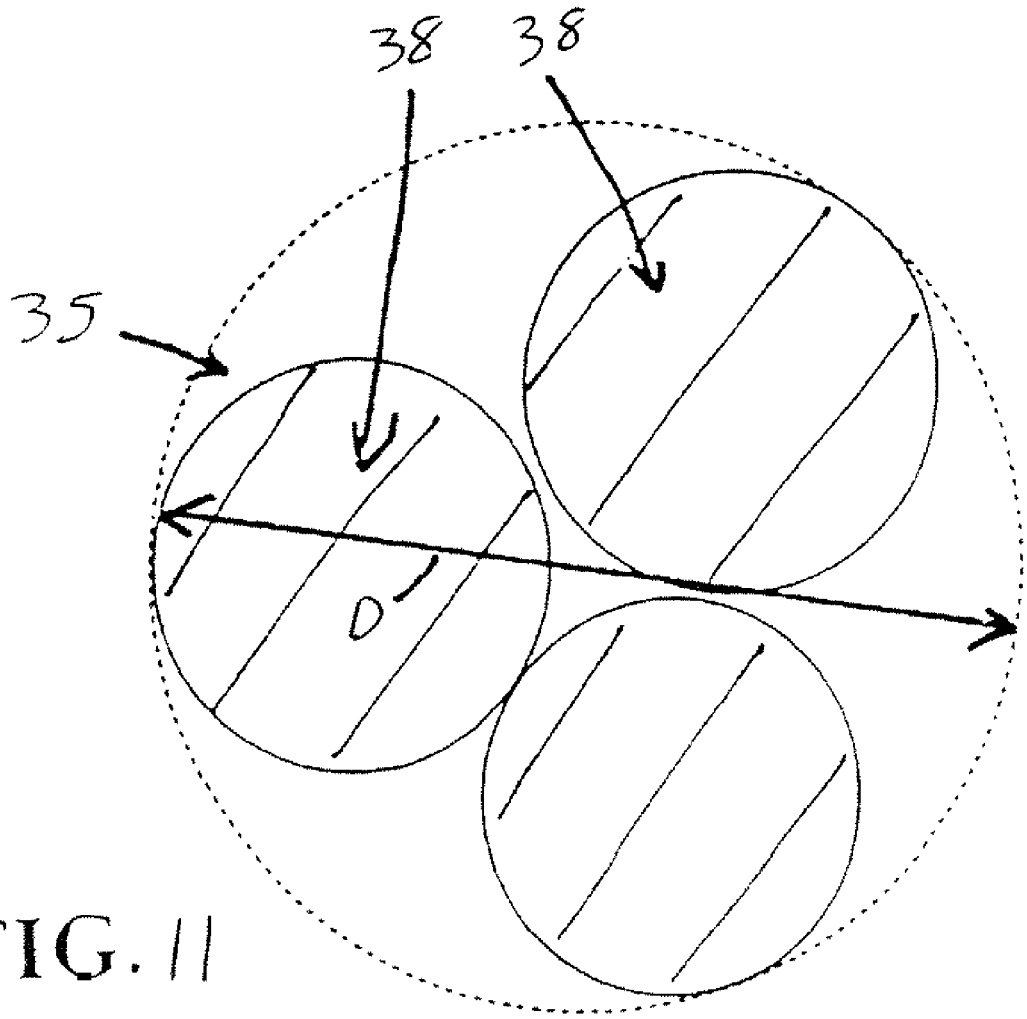
FIG. 11 is a cross-sectional view of one embodiment of a branch of a stem for use with an applicator brush, having three pre-twisted strands, with broken lines illustrating the periphery of a branch of circular cross-section having the same maximum diameter.
Figure 12:
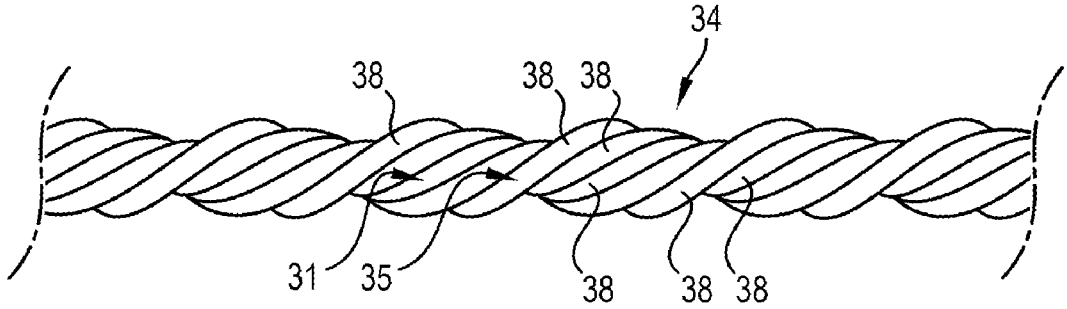
FIG. 12 is a plan view of one embodiment of a stem for use with an applicator brush made by twisting two branches as shown in FIG. 11.
Figure 13:
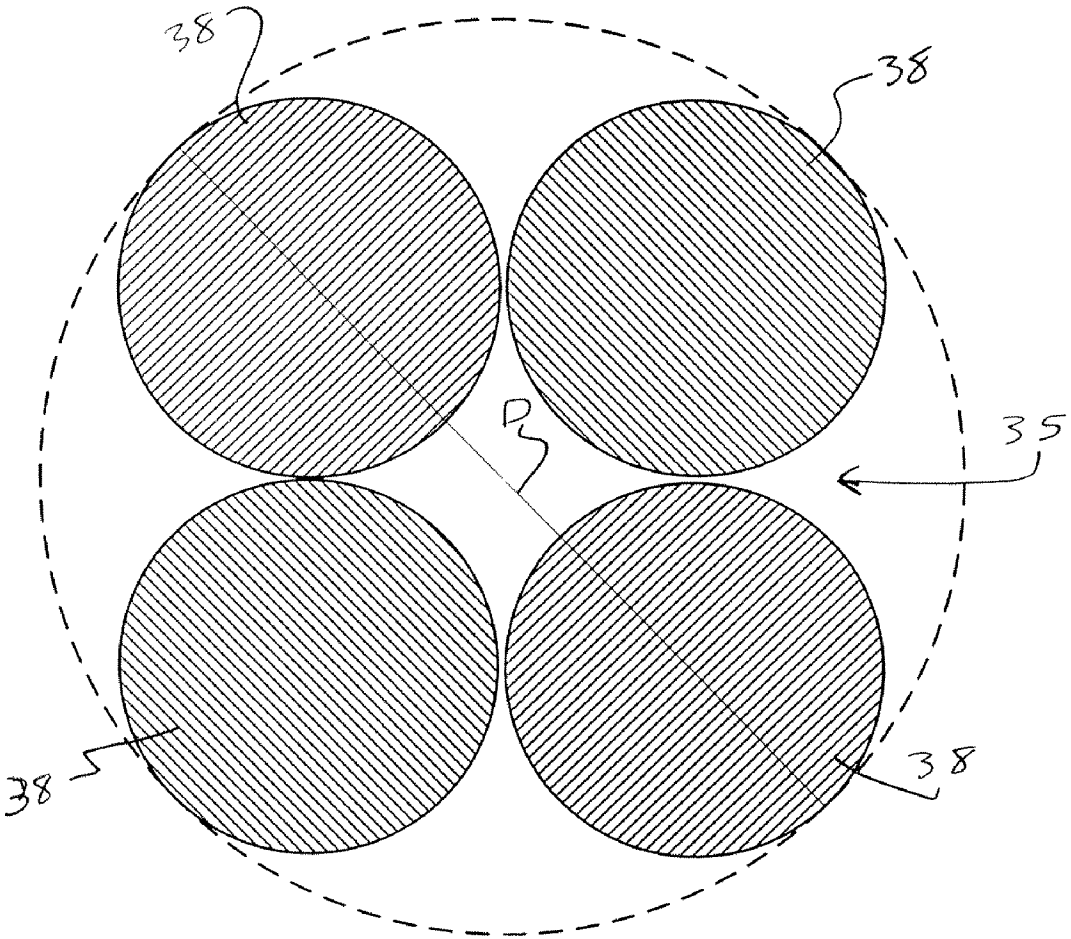
FIG. 13 is a cross-sectional view of one embodiment of a branch of a stem for use with an applicator brush, having four pre-twisted strands, with broken lines illustrating the periphery of a branch of circular cross-section having the same maximum diameter.
Figure 14:
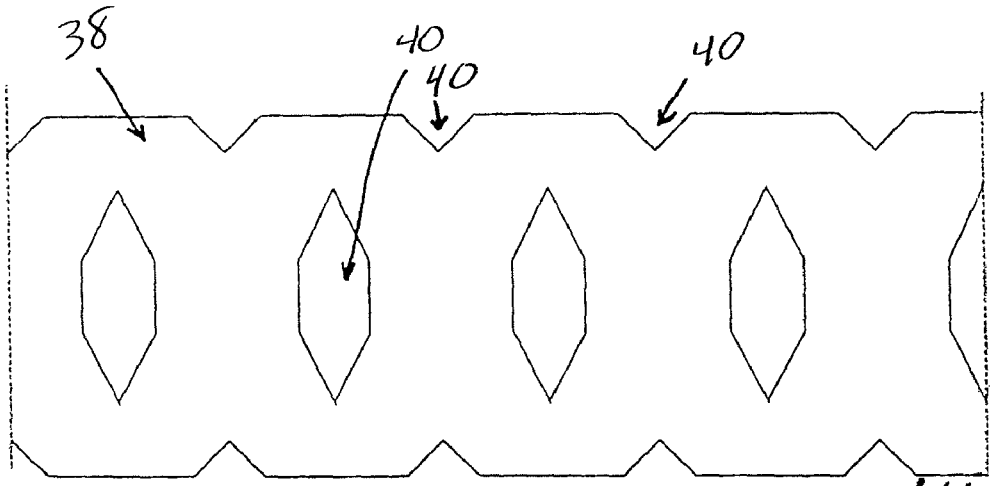
FIG. 14 is a top view of one embodiment of a strand having a variable cross-section.

In one embodiment, the stem 34 is constructed from a plurality of pre-twisted strands 38, as illustrated in FIGS. 8-14, to result in a multi-helicoidal stem 34. In this embodiment, each branch 35,37 is constructed of a plurality of strands 38 pre-twisted together to create the non-circular cross-section of each branch 35,37. More specifically, a plurality of strands 38 are twisted together to create the branches 35,37 as described above (i.e., pre-twisting), and then the branches 35,37 are twisted together with the bristles 32 to trap the bristles 32 and create the multi-helicoidal stem 34 (i.e., brush-twisting). FIGS. 8 and 9 illustrate a branch 35 constructed of two pre-twisted strands 38, and FIGS. 10 and 11 illustrate a stem 34 created from two brush-twisted branches 35,37, each branch 35,37 consisting of two strands 38 pre-twisted together. FIG. 12 illustrates a branch 35 constructed of three pre-twisted strands 38, and FIG. 13 illustrates a stem 34 created from two brush-twisted branches 35,37, each branch 35,37 consisting of three strands 38 pre-twisted together. FIG. 14 illustrates a branch 35 consisting of four strands 38 pre-twisted together. In FIGS. 9, 11, 12, and 14, a diameter (D) and a broken line outline are drawn, indicative of the diameter and circumference of a typical strand 38 having a circular cross-section of the same dimension. The spaces between the outer perimeter of the circle defined by diameter (D) and the outer periphery of the strand 38 permit the wider dispersion angle $\alpha$ of the bristles 32, relative to a circular cross-section. Additionally, because the branches 35,37 will be twisted, the configuration of the space between the adjacent twisted branches 35,37 will vary over the length of the stem 34, thus forming a changing non-uniform distribution of bristles 32 over the length of the stem 34.

It is contemplated that the stem 34 may be constructed from more than two branches 35,37, that each branch 35,37 may be constructed from any number of strands 38, and that one branch 35 may have a different number of strands 38 than another branch 37. For example, one of the branches 35,37 may be a single strand 38 having a circular, non-circular, or variable cross-section.

Figure 21A:
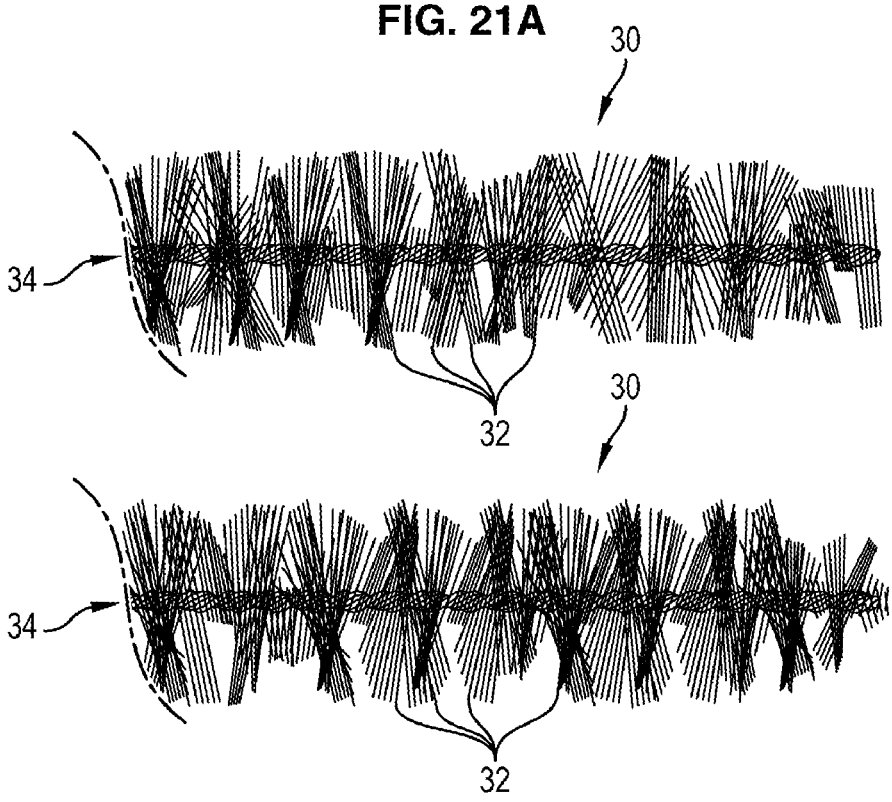
FIG. 21A is two plan views of an embodiment of a brush having four pre-twisted strands of the same diameter, the first view being rotated 90° from the second view.
Figure 21B:
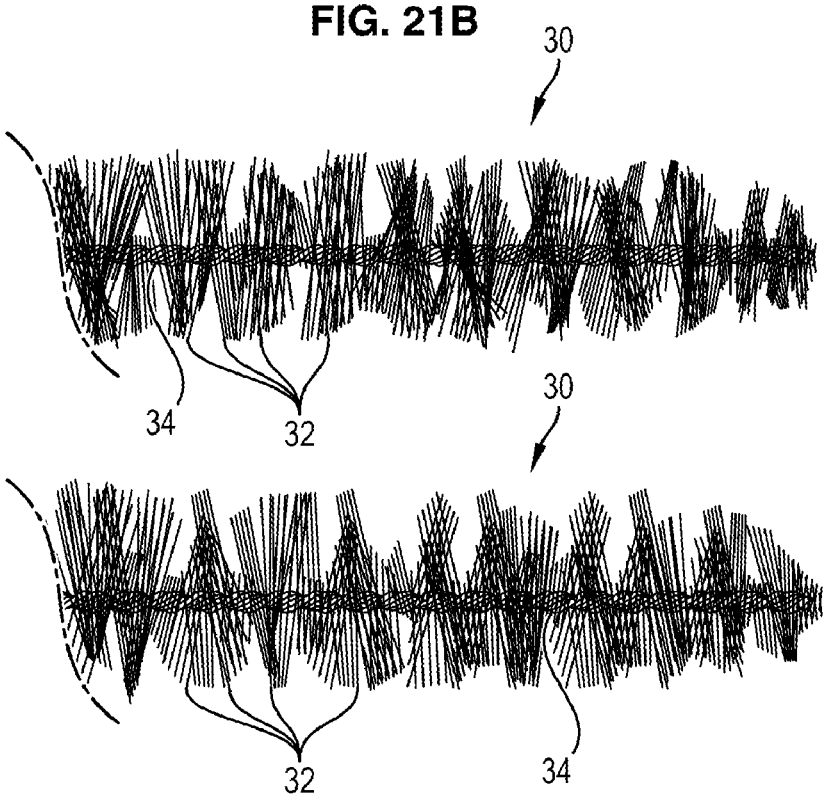
FIG. 21B is two plan views of an embodiment of a brush having four pre-twisted strands of varying diameter, the first view being rotated 90° from the second view.

By adjusting different parameters in constructing the stem 34, one skilled in the art can achieve different desirable effects in the brush 12. For example, changing certain parameters can result in the bristles 32 of the brush 12 having different patterns, densities, and spreads. The pre-twisting arrangement of the strands 38 can be varied, such as by pre-twisting the strands 38 in a clockwise manner, pre-twisting the strands 38 in a counterclockwise manner, pre-twisting the strands 38 in a braided manner, or pre-twisting the strands 38 in any other suitable manner. The material from which the strands 38 are made can also be varied, such as by using metallic wires, non-metallic fibers (such as natural fibers), or other suitable materials. In one embodiment, the strands 38 are stainless steel wires. The diameter and cross section of the strands 38 can be varied, and strands 38 of differing cross-sections and/or diameters can be mixed to form the stem 34. As it can be seen in FIGS. 21A-B, it has been found that mixing different diameter strands 38 provides a more complex bristle 32 pattern than using strands 38 of the same diameter. Each of the FIGS. 21A-B shows a first view of the brush 30, and a second view of the same brush 30, rotated at 90° axially.

Figure 22A:
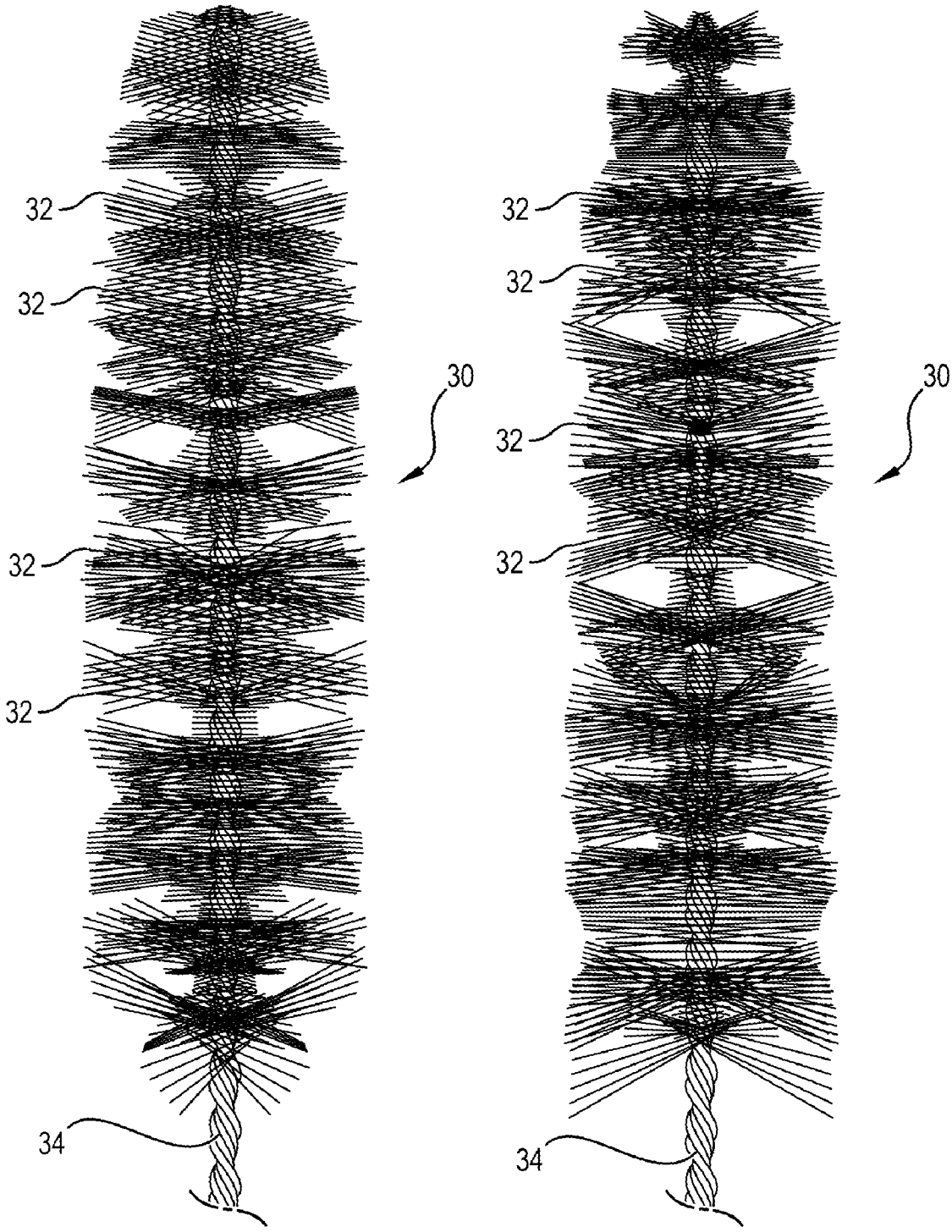
FIG. 22A is two plan views of a brush made with 0.4 mm strands and a lay length of 3.6 mm, the first view being rotated 90° from the second view.
Figure 22B:
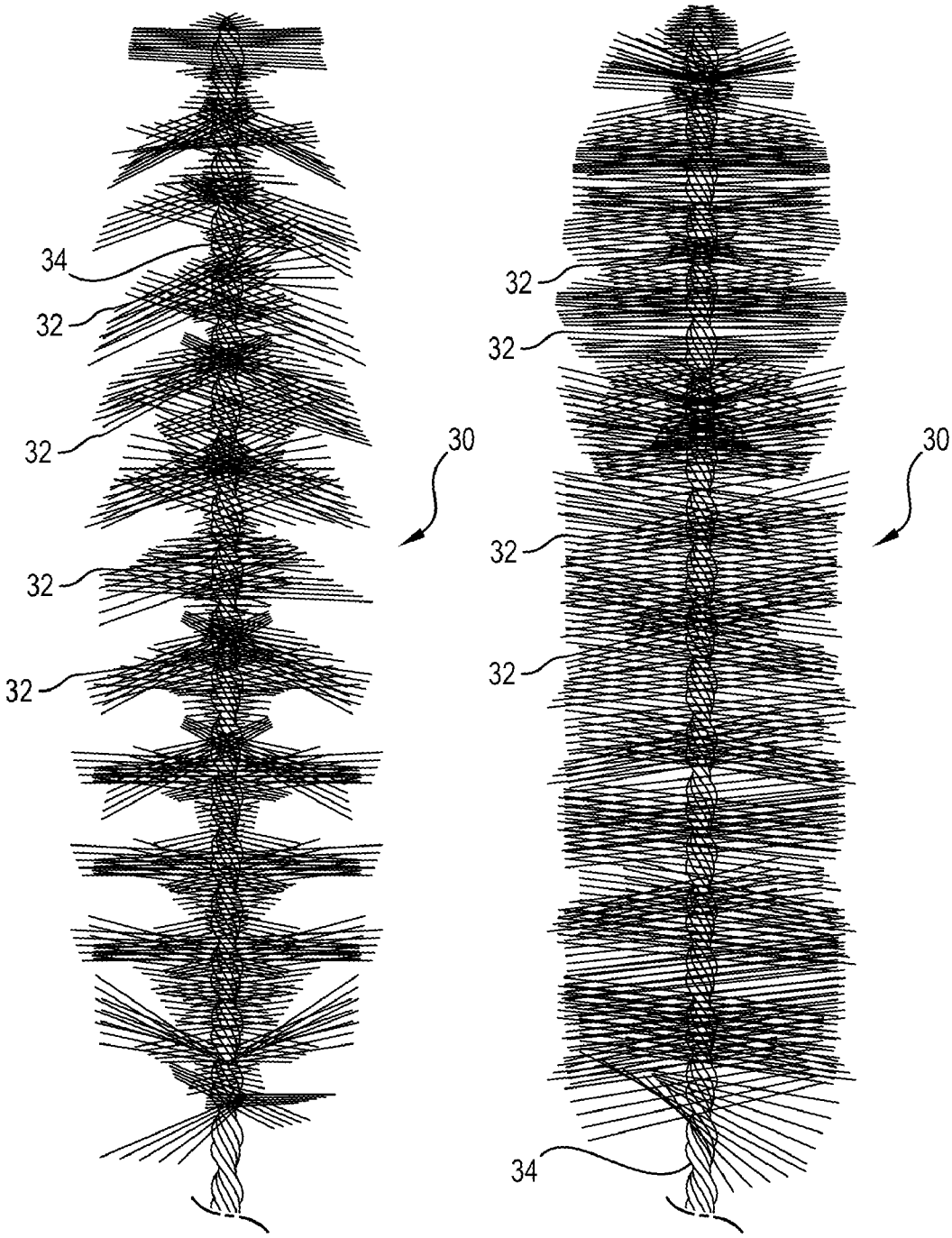
FIG. 22B is two plan views of a brush made with 0.4 mm strands and a lay length of 5.3 mm, the first view being rotated 90° from the second view.
Figure 22C:
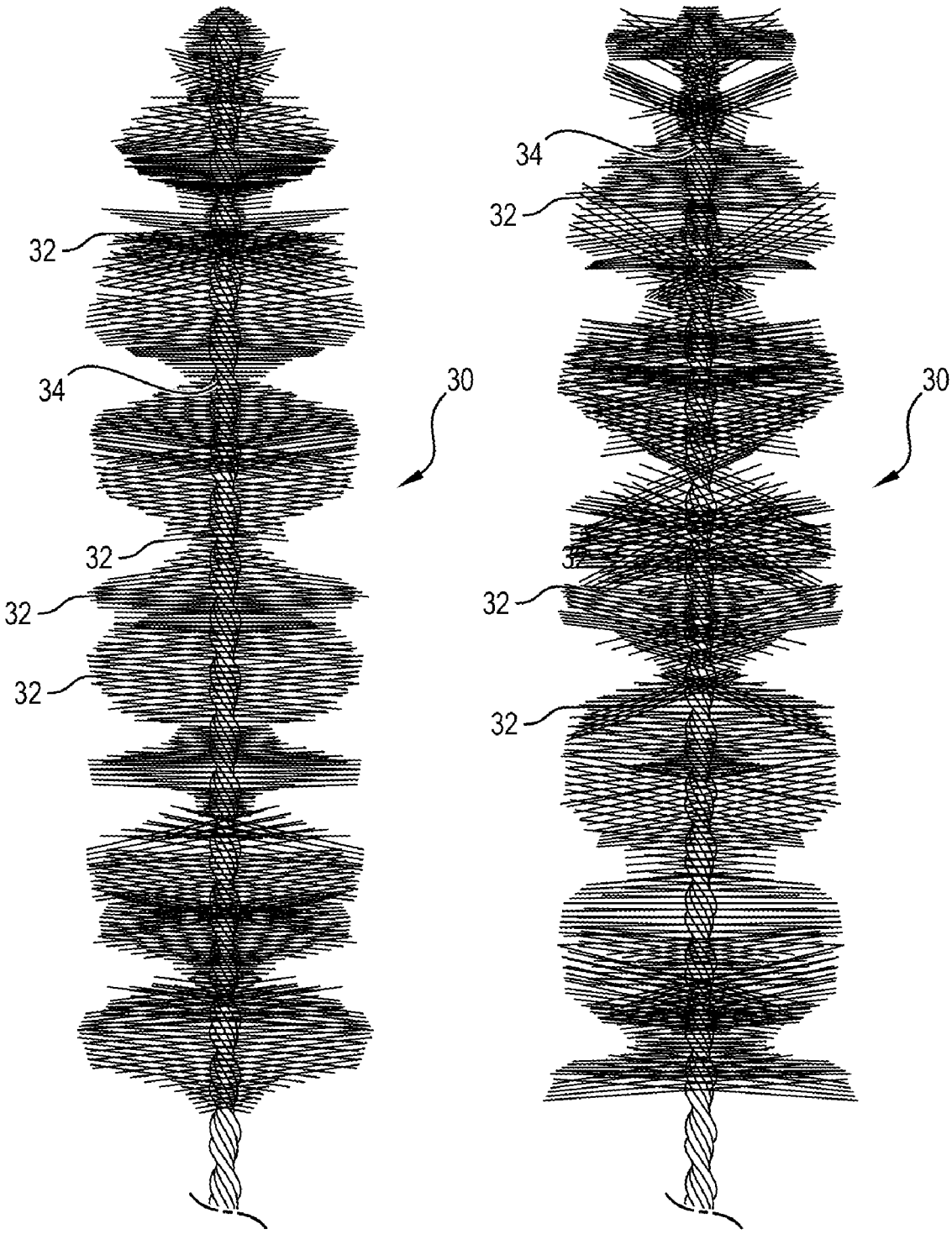
FIG. 22C is two plan views of a brush made with 0.4 mm strands and a lay length of 9.8 mm, the first view being rotated 90° from the second view.
Figure 23:
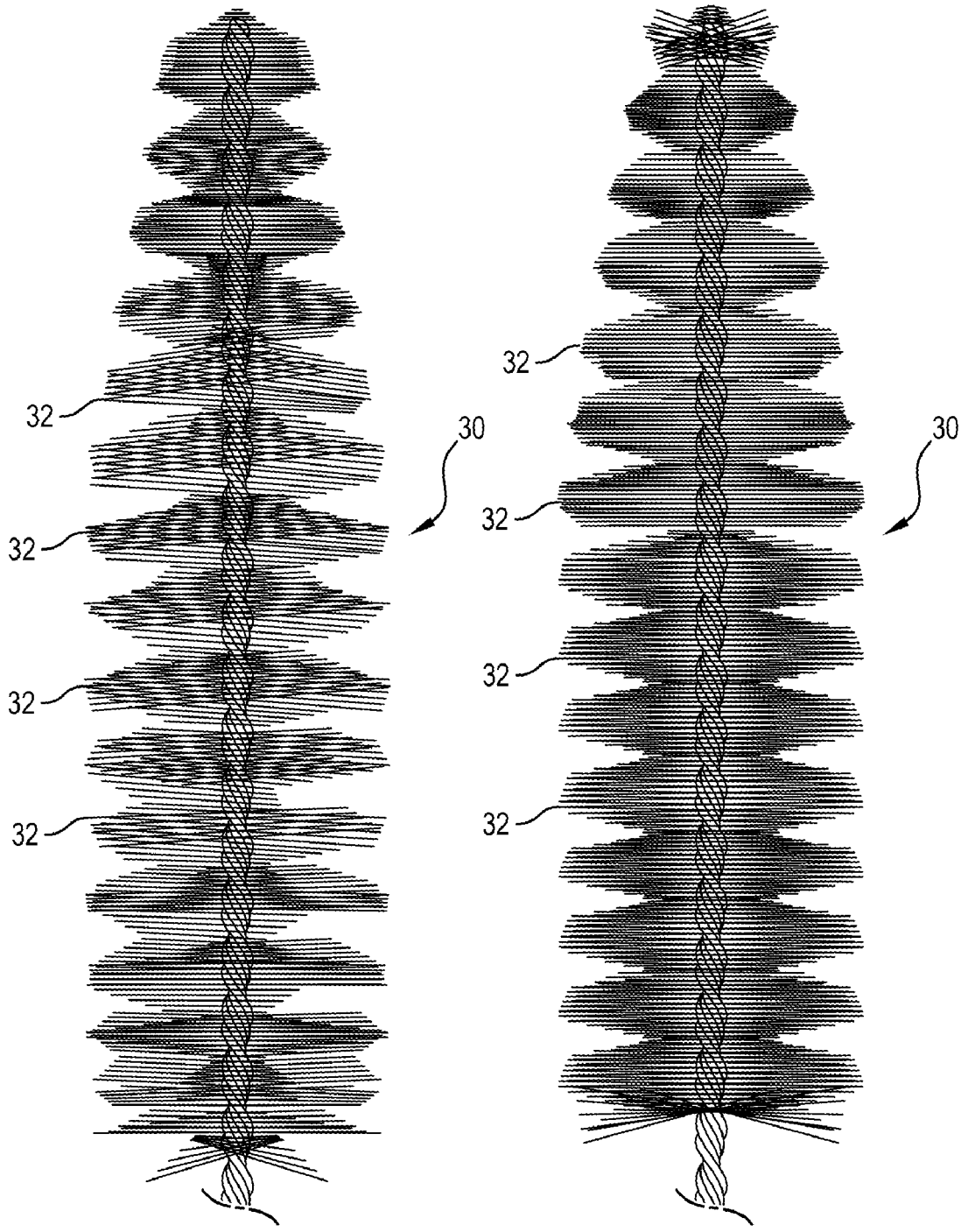
FIG. 23 (PRIOR ART)
FIG. 23 is two plan views of a prior art brush, the first view being rotated 90° from the second view.

Further, the repeat length of the pre-twist (lay length) and the number of twists on the final brush 12 can also be varied to create different effects. For a 0.4 mm strand 38, the lay length has been varied between 3.6 mm and 9.8 mm in order to obtain different effects, such as it can be seen in FIGS. 22A-C. The brush in FIG. 22A has a lay length of 3.6 mm, the brush in FIG. 22B has a lay length of 5.3 mm and the brush in FIG. 22C has a lay length of 9.8 mm, while all other parameters are the same for the three brushes shown. Each of the FIGS. 22A-C shows a first view of the brush 30, and a second view of the same brush 30, rotated at 90° axially. It has been found that the higher the number of twist impulsions, the more spreading occurs in the bristles 32 of the finished brush 12. However, twist impulsion values are generally machine-dependent.

Assembling or manufacturing the applicator brush 12 is described with respect to the embodiments illustrated in FIGS. 3-6. A plurality of strands 38 are provided, as described above, and the strands 38 are pre-twisted together to form the stem 34. FIGS. 8-13 show different embodiments of stems 34 having a plurality of strands 38 pre-twisted together, and are described above. The stem 34 is then bent or folded at an angle of approximately 180 degrees at a fold point 33, creating the pin 36 having the first branch 35 and the second branch 37. A folded stem 34 is shown in FIGS. 3 and 5. In one embodiment, the fold point 33 is approximately at a center point or mid point 33 of the unfolded stem 34. A plurality of bristles 32 are then arranged between the branches 35,37 of the pin 36. In one embodiment, shown in FIGS. 4 and 5, the bristles 32 are positioned in parallel relation to each other and in a non-perpendicular angled relation to the axial direction of the first branch 35 and the second branch 37. As shown, the bristles 32 are generally centered with respect to the pin 36, although this arrangement may vary in some embodiments. The branches 35,37 are then twisted together to secure the bristles 32 between the first and second branches 35,37 by compressive forces, such that the bristles 32 radiate from the twisted stem 34 in a plurality of directions. It is observed that the twisting of two pre-twisted branches 35,37 creates the brush portion 30 having a multi-helicoidal stem 34, as described above. The brush portion 30 is then attached to the handle portion 20. In the embodiment shown in FIGS. 1 and 2, a portion of the stem 34 is inserted into one end 25 of the rod 24 to attach the brush portion 30 to the handle portion 20. However, in other embodiments, this connection may be different. Embodiments without a handle portion 20 are also within the scope of the present invention. The container 14 may be filled, such as with mascara or another cosmetic, and then the brush portion 30 is inserted into the end opening 15 of the container and into the cavity 16, where the bristles 32 come in contact with the cosmetic. The cap portion 22 of the handle 20 can be affixed to the container 14, such as by threading 18, and this attachment can advantageously create an airtight seal to preserve the cosmetic and prevent spillage. When the brush 12 is removed from the container 14, the collared portion 17 wipes excess cosmetic from the bristles 32, and then the brush 12 can be used to apply the cosmetic as desired.

Figure 15:
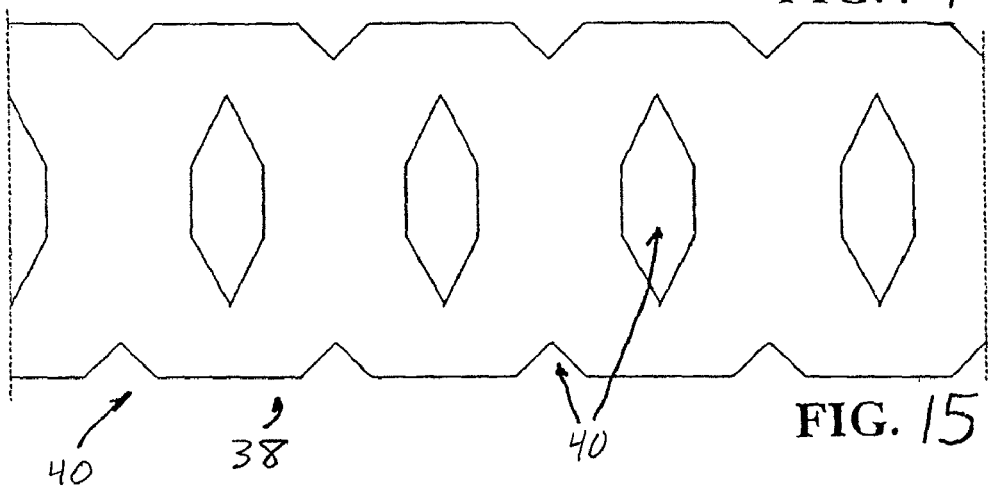
FIG. 15 is a side view of the strand of FIG. 14.
Figure 16:
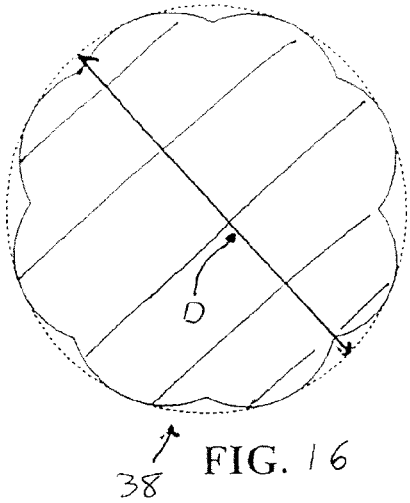
FIG. 16 is a cross-sectional view of one embodiment of a strand having a continuous non-circular cross section.
Figure 19:
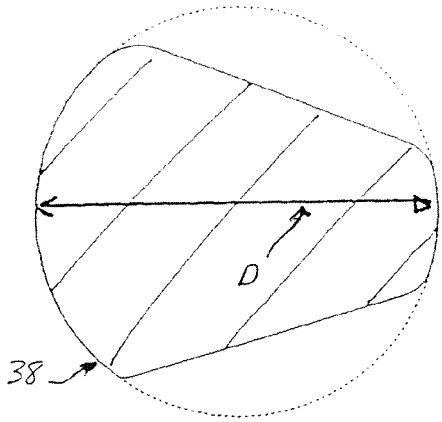
FIG. 19 is a cross-sectional view of a fourth embodiment of a strand having a continuous non-circular cross section.
Figure 17:
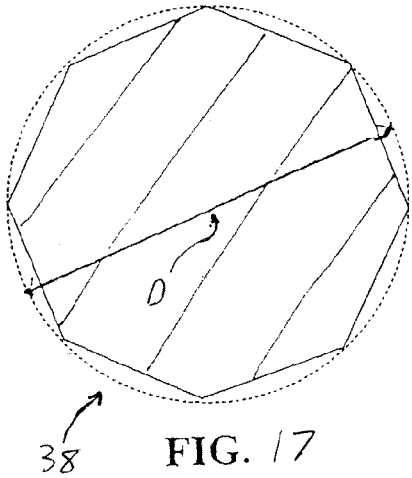
FIG. 17 is a cross-sectional view of a second embodiment of a strand having a continuous non-circular cross section.
Figure 20:
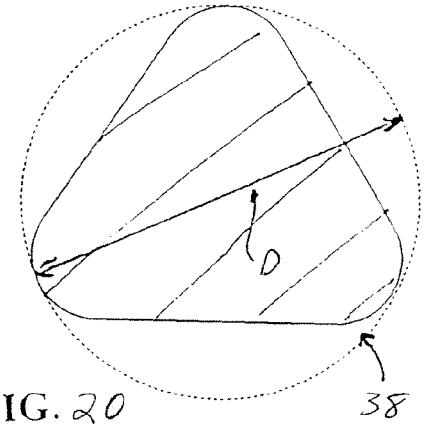
FIG. 20 is a cross-sectional view of a fifth embodiment of a strand having a continuous non-circular cross section.
Figure 18:
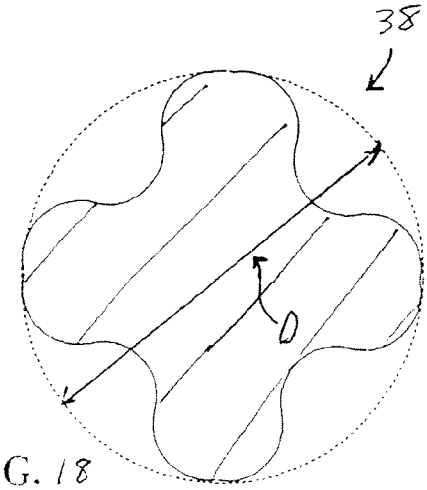
FIG. 18 is a cross-sectional view of a third embodiment of a strand having a continuous non-circular cross section.

In other embodiments, the non-circular cross-section of the branches 35,37 may be created in a different manner, such as by using a single strand having a non-circular or variable cross-section. FIGS. 14-20 illustrate several different embodiments of strands 38 used to create branches 35,37 having non-circular cross-sections. FIGS. 14 and 15 show a strand 38 having a variable cross-section, achieved by creating one or more notches or recessed portions 40 around the outside of the strand 38. As shown, the recessed portions 40 are transverse or inclined with respect to the local axial direction of the strand 38, and are arranged into a regular pattern. However, the strand 38 may alternately have a different pattern or a random arrangement in other embodiments. In still further embodiments, other means and structure for creating a variable cross-section may be used. FIGS. 16-20 show strands 38 having a variety of continuous, non-circular cross-sections. It is understood that the description of the cross-section as "continuous" contemplates that the strand 38 will be twisted. In each of these FIGS., a diameter (D) and a broken line outline are drawn, indicative of the diameter and circumference of a typical strand 38 having a circular cross-section of the same dimension. As described above, the spaces between the outer perimeter of the circle defined by diameter (D) and the outer periphery of the strand 38 permit the wider dispersion angle $\alpha$ of the bristles 32, relative to a circular cross-section. Additionally, because the outer profile of the strands 38 in FIGS. 14-20 vary, the configuration of the space between the adjacent twisted branches 35,37 will vary over the length of the stem 34, thus forming a changing non-uniform distribution of bristles 32 over the length of the stem 34.

The disclosed brush assembly 10 provides many advantages and benefits. Due to the increased expansion of the bristles, the brush can be used even with the most recent mascara formulations put on the market, including relatively fluid formulations. Additionally, by controlling the variable parameters described herein, achieving different expansions and distributions of the bristles, the brush can create application effects on eyelashes that cannot be obtained with traditional brushes. Such application effects include eyelash thickening effects, volumizing effects, combing effects, sculpting effects, cleaner application, gripping and stretching lashes, superior loading, creating mini-groups of lashes and other beneficial effects. As a result, brushes can be customized to achieve certain desired effects, and to accomplish new or superior effects compared to other brushes currently available.

In other embodiments, brush assemblies 10 according to the present invention may be advantageously used for different purposes, such as cleaning (baby bottle cleaning brushes) or in the medical field (catheter brushes).

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. The terms "first," "second," etc., as used herein, are intended for illustrative purposes only and do not limit the embodiments in any way. Additionally, the term "plurality," as used herein, indicates any number greater than one, either disjunctively or conjunctively, as necessary, up to an infinite number. Accordingly, while the specific embodiments have been illustrated and described, numerous modifications come to mind without significantly departing from the spirit of the invention and the scope of protection is only limited by the scope of the accompanying claims.

What is claimed is:

1. An applicator brush comprising:

a stem extending from an end of a rod, the stem comprising a first branch and a second branch twisted together, wherein each branch has a non-circular cross-section over at least a portion of a length thereof wherein each of the first and second branches comprises a plurality of strands pre-twisted together to create the non-circular cross-section of each branch, and wherein the stem is multi-helicoidal; and a plurality of bristles supported by the stem, wherein the bristles are positioned between the twisted first and second branches, and wherein both the first branch and the second branch exert compressive forces on each of the plurality of bristles, the bristles being secured between said twisted first and second branches twisting together.

2. The applicator brush of claim 1, wherein each branch comprises a number of strands in the range of from two to four.

3. The applicator brush of claim 2, wherein the number of strands in one of the branches is two.

4. The applicator brush of claim 2, wherein the number of strands in one of the branches is three.

5. The applicator brush of claim 2, wherein the number of strands in one of the branches is four.

6. The applicator brush of claim 1, wherein the plurality of strands are twisted in a clockwise manner.

7. The applicator brush of claim 1, wherein the plurality of strands are twisted in a counterclockwise manner.

8. The applicator brush of claim 1, wherein the plurality of strands are twisted in a braided manner.

9. The applicator brush of claim 1, wherein the strands are metallic wires.

10. The applicator brush of claim 1, wherein the strands are non-metallic fibers.

11. The applicator brush of claim 10, wherein the strands are natural fibers.

12. The applicator brush of claim 1, wherein the strands have different diameters.

13. The applicator brush of claim 1, wherein the branches are continuous with each other and are formed by folding the stem at an angle of approximately 180 degrees to form a pin having the first and second branches.

14. The applicator brush of claim 1, further comprising a handle portion adapted to be held by a user, the handle portion having said rod extending therefrom.

15. A cosmetic applicator brush assembly comprising:

a container adapted to contain a cosmetic substance, the container having an end opening;

a handle portion adapted to be held by a user, the handle portion attachable to the container to cover the end opening and having a rod extending therefrom;

a multi-helicoidal stem extending from an end of the rod, the stem comprising a plurality of strands pre-twisted together and folded at an angle of approximately 180 degrees to form a pin having a first branch and a second branch, the first branch and the second branch twisted together to form the multi-helicoidal stem; and a plurality of bristles supported by the stem, wherein each of the bristles is secured by radial pressure exerted by the twisted first and second branches twisting together, wherein the stem and bristles are positioned within the container when the handle portion is attached to the container to cover the end opening.

16. The cosmetic applicator brush assembly of claim 15, wherein the stem comprises a number of strands in the range of from two to four.

17. The cosmetic applicator brush assembly of claim 16, wherein the number of strands is two.

18. The cosmetic applicator brush assembly of claim 16, wherein the number of strands is three.

19. The cosmetic applicator brush assembly of claim 16, wherein the number of strands is four.

20. The cosmetic applicator brush assembly of claim 15, wherein the container and the handle portion have complementary interlocking structures to attach the handle portion to the container.

21. The applicator brush of claim 15, wherein the strands have different diameters.

22. An applicator brush comprising:

a handle portion adapted to be held by a user, the handle portion having a rod extending therefrom;

a stem extending from an end of the rod, the stem comprising a first branch comprising a plurality of strands pre-twisted together and a second branch comprising a plurality of strands pre-twisted together, wherein the first branch and the second branch are twisted together to form the stem; and a plurality of bristles supported by the stem, wherein the bristles are positioned between the twisted first and second branches, and wherein each of the bristles is secured by radial pressure exerted by the twisted first and second branches twisting together.

23. The applicator brush of claim 22, wherein the first branch and the second branch are twisted together through 8 to 24 turns.

* * * * *